United States Patent [19]

Miyashita et al.

[11] Patent Number: 4,871,947

[45] Date of Patent: Oct. 3, 1989

[54] APPARATUS FOR AUTOMATICALLY CORRECTING ARC POSITION OF HIGH PRESSURE DISCHARGE LAMP

[75] Inventors: Tsune Miyashita, Tokyo; Makoto Yasuda, Kodaira, both of Japan

[73] Assignee: Hitachi, Ltd., Tokyo, Japan

[21] Appl. No.: 206,096

[22] Filed: Jun. 13, 1988

[30] Foreign Application Priority Data

Jun. 12, 1987 [JP] Japan ..... 62-145264
Aug. 25, 1987 [JP] Japan ..... 62-209318

[51] Int. Cl.[4] ..... H01J 17/14

[52] U.S. Cl. ..... 315/344; 313/154; 313/156; 313/161; 315/151; 315/156; 356/122

[58] Field of Search ..... 313/153, 156, 161; 315/344–348, 149, 151, 155; 356/122

[56] References Cited

U.S. PATENT DOCUMENTS 3,493,763 2/1970 Hannappel ..... 315/348 X
3,562,583 2/1971 Zollweg et al. ..... 315/344
4,064,418 12/1977 Kearney ..... 315/347 X
4,720,660 1/1988 Whelan ..... 313/161 X
4,780,645 10/1988 Toho et al. ..... 315/344 X

FOREIGN PATENT DOCUMENTS 49-5112 2/1974 Japan .

*Primary Examiner*—James J. Groody
*Assistant Examiner*—Mark R. Powell
*Attorney, Agent, or Firm*—Fay, Sharpe, Beall, Fagan, Minnich & McKee

[57] ABSTRACT

Disclosed is an apparatus for stabilizing the light output of a high pressure discharge lamp comprising a coil generating a magnetic field acting upon the arc of the high pressure discharge lamp, an arc position detector detecting deviation of the position of the arc, and a magnetic field control circuit controlling the coil in response to the deviation detection output signal of the the arc position detector thereby setting right the position of the arc of the high pressure discharge lamp.

6 Claims, 2 Drawing Sheets

APPARATUS FOR AUTOMATICALLY CORRECTING ARC POSITION OF HIGH PRESSURE DISCHARGE LAMP

BACKGROUND OF THE INVENTION

This invention relates to an apparatus for stabilizing the light output of a high pressure discharge lamp which generates a highly stable light output when used as a light source in an apparatus for performing spectrochemical analysis, for example, an absorption photometer.

Light used in the field of spectrochemical analysis occupies a wide wavelength range of from the ultraviolet range to the visible range of the spectrum. Especially, in an apparatus used for qualitative and quantitative analysis of a substance by absorption, among various apparatus designed for performing spectrochemical analysis, it is very important for its light source to be able to generate a light output which is substantially free from fluctuation. However, even in a metal halide lamp especially developed for the purpose of minimizing fluctuation of its light output, it is difficult to decrease fluctuation of the light output to less than 0.05%. In a high vapor pressure discharge lamp commonly used for illumination purpose, such as, a high pressure mercury lamp, a high pressure sodium lamp, a metal halide lamp or the like in which the vapor pressure during operation is about 1 atm or more, fluctuation of about 0.5% occurs commonly in its light output, and light output fluctuation of about several percent occurs when the arc snakes.

Methods for preventing snaking of the arc in such a lamp by imparting a magnetic force to the arc have already been proposed, as disclosed in Japanese Utility Model Publication No. 49-5112 (filed by Mitsubishi Electric Corporation on Mar. 17, 1969) and U.S. Pat. No. 3,562,583 filed on Jan. 27, 1969 by Robert J. Zollweg et al. The proposed methods have been effective for preventing the illumination light output of such a lamp from flickering and for preventing determination of the lamp performance due to bowing of the arc, thereby ensuring good life performance of the lamp. However, the proposed methods have not been sufficient to meet the demand for highly stabilizing the light output, that is, decreasing the fluctuation of the light output to less than 0.05%.

As pointed out above, the prior art high pressure discharge lamp has been insufficient in the stability of its light output and has not been suitable for use as a light source of a spectrochemical analyzing apparatus such as an absorption photometer in which the light source is required to generate a highly stable light output.

SUMMARY OF THE INVENTION

It is an object of the present invention to provide an apparatus for stabilizing the light output of a high pressure discharge lamp so that the high pressure discharge lamp can generate a highly stabilized light output in which fluctuation is decreased to less than 0.05%.

The above object is attained by detecting deviation of the position of the arc in the high pressure discharge lamp and imparting a magnetic force to the arc in an amount sufficient to cancel the detected position deviation, thereby setting right the position of the arc.

In an embodiment of the apparatus for stabilizing the light output of a high pressure discharge lamp according to the present invention, a magnetic field is generated by current supplied to a coil disposed in the vicinity of the high pressure discharge lamp to change the position of the arc by the Lorentz force, and the arc is fixed at a desired position under control of apparatus provided for monitoring the position of the arc. Thus, the arc is prevented from undergoing a positional change such as fluctuation attributable to snaking or convection in the discharge tube, so that undesirable fluctuation of the light output of the high pressure discharge lamp can be minimized.

DESCRIPTION OF THE PREFERRED EMBODIMENTS

Figure 1:
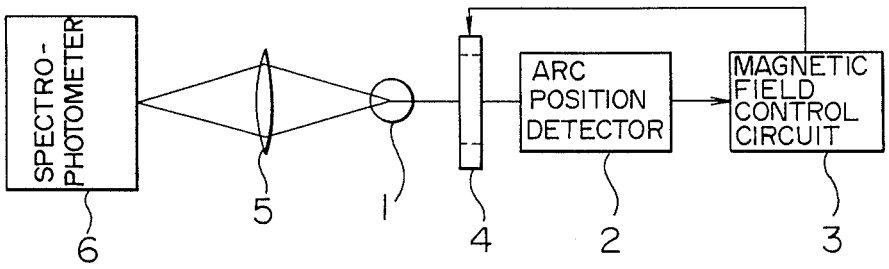
FIG. 1 is a block diagram of a first embodiment of the apparatus for stabilizing the light output of a high pressure discharge lamp according to the present invention.

FIG. 1 is a block diagram of a first embodiment of the apparatus for stabilizing the light output of a high pressure discharge lamp according to the present invention. Referring to FIG. 1, the reference numerals 1, 2, 3, 4, 5 and 6 designate a high pressure discharge lamp, an arc position detector, a magnetic field control circuit, a coil that generates a magnetic field, a lens, and a spectrophotometer, respectively. The light output of the high pressure discharge lamp 1 is condensed by the lens 5 to be formed an image on an inlet slit of the spectro-photometer 6. The intensity of the light input to the spectrophotometer 6 is influenced by time-dependent fluctuation of the light output of the high pressure discharge lamp 1 and fluctuation of the light output attributable to deviation of the arc position in the high pressure discharge lamp 1. In the two kinds of light output fluctuations described above, the former fluctuation can be compensated by a method according to which the high pressure discharge lamp 1 is operated by a constant current circuit on a method according to which the light input to the spectro-photometer 6 is divided into two radiant fluxes passing along different paths in the spectro-photometer and one of the two radiant fluxes is used as a reference light. However, since the latter fluctuations cannot be sufficiently compensated by the method described above, the deviation of the arc position must be compensated in the high pressure discharge lamp itself.

The coil 4 is provided for the purpose of the compensation of the latter fluctuation and generates a magnetic field controlled by the magnetic field control circuit 3 so as to set right the arc position. When the length of the arc is 1 cm, and the arc current is 0.7 A, the coil 4 is preferably in the form of a coreless coil in which the coil radius is 1.5 cm, and the number of turns is 12. The coil 4 is disposed at a position spaced apart from the arc by a distance of 1.5 cm, and the central axis of the coil 4 is orthogonal with respect to the axis of the arc. When coil current of about 0.1 A is supplied to the coil 4, deviation of the arc position can be sufficiently compensated by the Lorentz force of the magnetic field generated by the coil 4. The arc position detector 2 is provided with a pin hole having a diameter of 0.5 mm, and the image of the arc is focused through the pin hole on a focal plane. Two photo diodes spaced from each other are disposed on the focal plane so that an increase or a decrease in the difference between the quantities of light incident upon these two photo diodes represents the deviation of the arc position. A signal representing the detected deviation of the arc position is converted by the magnetic field control circuit 3 into a corresponding compensating coil current supplied to the coil 4.

When the length of the arc is 5 cm, and the arc current is 3.3 A, a coreless coil 4 having a coil radius of 5 cm and 20 coil turns is used as the coil 4. By disposing this coil 4 at a position spaced apart from the arc by a distance of 6 cm and supplying a coil current of about 0.1 A to the coil 4, the deviation of the arc position can be sufficiently compensated.

Figure 2:
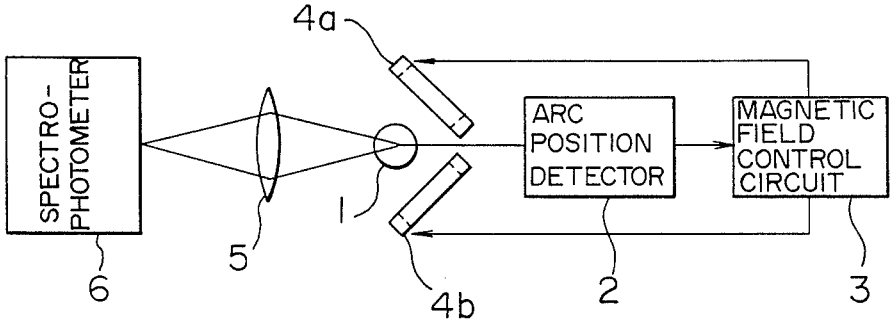
FIG. 2 is a block diagram of a second embodiment of the stabilizing apparatus of the present invention.

FIG. 2 is a block diagram showing a second embodiment of the present invention. The second embodiment shown in FIG. 2 is a modification of the first embodiment shown in FIG. 1. Referring to FIG. 2, two magnetic field generating coils 4*a* and 4*b* generate individual magnetic fields in such a relation that the resultant magnetic field of the two magnetic fields can sufficiently compensate both of deviation of the arc position orthogonal to the light axis and deviation of the arc position parallel to the light axis.

Figure 3:
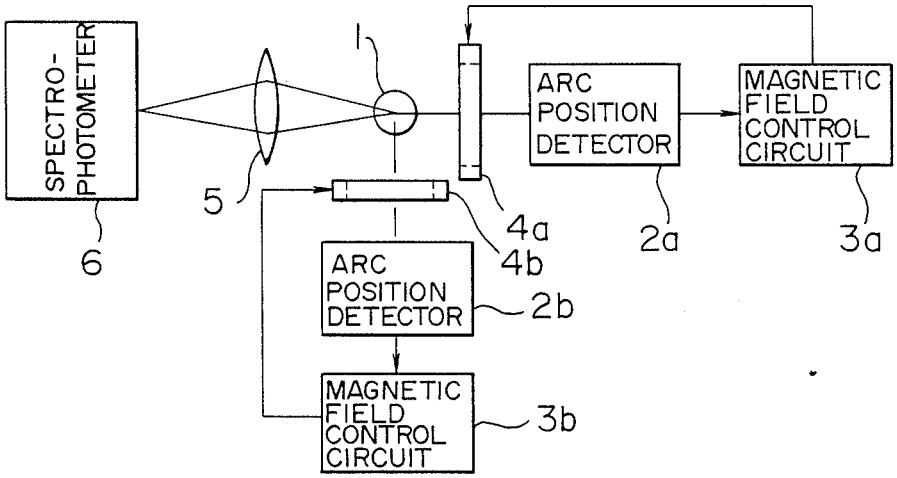
FIG. 3 is a block diagram of a third embodiment of the stabilizing apparatus of the present invention.

FIG. 3 is a block diagram showing a third embodiment of the present invention. The third embodiment shown in FIG. 3 is a modification of the first embodiment shown in FIG. 1 in that two arc position detectors 2*a*, 2*b*, two magnetic field control circuits 3*a*, 3*b* and two magnetic field generating coils 4*a*, 4*b* are disposed in directions orthogonal and parallel to the light axis respectively. Deviation of the arc position in a direction orthogonal to the light axis can be sufficiently compensated by the coil 4*a*, and deviation of the arc position in a direction parallel to the light axis can be sufficiently compensated by the coil 4*b*.

Deviation of the arc position appears as corresponding light output fluctuation whose frequency is lower than several ten Hz. Therefore, when the arc position detector 2 and magnetic field control circuit 3 have an operating frequency band of several kilohertz, they can sufficiently deal with compensation of deviation of the arc position. A frequency band higher than that specified above is undesirable, because unnecessary oscillation tends to occur. As described already, the signal representing the difference between the outputs of the two photo diodes provided in the arc position detector 2 represents the amount of deviation of the arc position. When, at the same time, a signal representing the sum of the outputs of the two photo diodes is obtained, such a signal represents the amount of time-dependent fluctuation of the light output of the high pressure discharge lamp and can be used to control the input to the high pressure discharge lamp 1 or can be used as a reference signal for the spectro-photometer 6. A third photo diode may be disposed between the two photo diodes, and its output signal may be used in lieu of the sum signal. A photo diode array may be used to replace the photo diodes described above. In such a case, the distance between the arc position detecting photo diodes can be decreased so as to reduce the size of the arc position detector 2. Further, a lens or the like may be used in lieu of the pin hole of the arc position detector 2. The arc position detector 2 may be disposed in the vicinity of the inlet slit of the spectro-photometer 6 or in the interior of the spectro-photometer 6. Similarly, the coil 4 may be disposed on the side of the lens 5. In each of the above cases, fluctuation of the lamp light output focused on the inlet slit of the spectro-photometer 6 can be decreased to less than 0.05% as described in the embodiments of the present invention. Such a lamp light output having its fluctuation decreased to less than 0.05% is generally equivalent to fluctuation of the light output of a deuterium lamp which generates light very stably.

Figure 4:
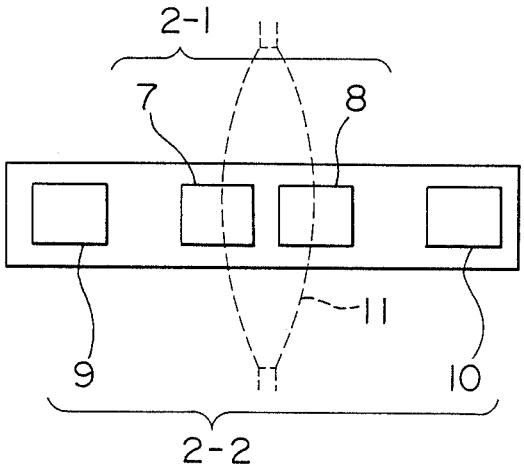
FIG. 4 is a diagrammatic view showing an arrangement of light detectors in an arc position detector in a fourth embodiment of the stabilizing apparatus of the present invention.

FIG. 4 shows an arrangement of light detectors in an arc position detector in a fourth embodiment of the present invention. In FIG. 1, the image of the arc is focused through the pin hole having the diameter of 0.5 mm on the focal plane of the arc position detector 2. Referring to FIG. 4, two light detectors 2-1 and 2-2 each including two photo diodes are disposed in the focal plane. More precisely, the first light detector 2-1 is composed of two photo diodes 7 and 8, while the second light detector 2-2 is composed of two photo diodes 9 and 10, and an increase or a decrease in the quantity of light incident upon the photo diodes in each of the light detectors 2-1 and 2-2 is determined as an amount of deviation of the arc position detected by each of the light detectors 2-1 and 2-2. The dotted lines 11 shown in FIG. 4 indicate an example of the state of the arc. Thus, the amount of deviation of the arc position detected by the first light detector 2-1 differs from that detected by the second light detector 2-2. When the amount of deviation of the arc position detected by the second light detector 202, in which the spacing between the photo diodes 9 and 10 is wider than that between the photo diodes 7 and 8 in the first light detector 2-1, does not exceed a predetermined value, the amount of deviation of the arc position detected by the first light detector 2-1, is decided as the amount of detected deviation of the arc position. On the other hand, when the amount of deviation of the arc position detected by the second light detector 202 exceeds the predetermined value, the amount of deviation of the arc position detected by the second light detector 2-2 is decided as the amount of detected deviation of the arc position. A signal representing the amount of deviation of the arc position decided in the manner described above is converted by the magnetic field control circuit 3 into a necessary current to be supplied to the coil 4.

When the length of the arc in the high pressure discharge lamp 1 is 5 cm, and the arc current is 3.3 A, the coil 4 is preferably in the form of a coreless coil having a coil radius of 5 cm and 20 coil turns. When this coil 4 is disposed at a position spaced apart from the arc by a distance of 6 cm, and a coil current of about 0.1 A is supplied to the coil 4, deviation of the arc position can be sufficiently compensated. When the arc deviates from the monitoring range of the first light detector 2-1 of the arc position detector 2 due to occurrence of some unusual situation (for example, a strong magnet is brought near the high pressure discharge lamp 1), the first light detector 2-1 will generate a unusual output signal. In such a situation, however, the level of the output signal of the second light detector 2-2 exceeds the predetermined level, and the output signal of the second light detector 2-2 is used now as the output signal of the arc position detector 2. This signal is converted by the magnetic field control circuit 3 into a necessary signal supplied to the coil 4 so that the arc can be restored to the original predetermined position.

Therefore, after the cause giving rise to the unusual situation described above is removed, the arc can be restored to the original predetermined position. Thereafter, the light output of the high pressure discharge lamp 1 can be highly stabilized on the basis of the output signal of the first light detector 2-1 having a higher accuracy of arc position detection.

Similarly, a third light detector 2-3 (not shown) including two photo diodes having a spacing wider than that of the photo diodes 9 and 10 shown in FIG. 4 may be further provided for the purpose of arc position detection, and, when the level of the output signal of this third light detector 2-3 exceeds a predetermined level, the output signal of the third light detector 2-3 may be used as the output signal of the arc position detector 2.

Further, when the oscillation frequency of the arc position setting-right system including the second light detector 2-2 is selected to be different from that of the arc position setting-right system including the first light detector 2-1, undesirable interference between the oscillations causing a resonance can be prevented. Also, when the first and second light detectors 2-1 and 2-2 detect different wavelengths of the arc respectively, the different of phases of vibration between at the central portion of the arc and at the peripheral portion of the arc interfere each other inside the arc position detector 2, so that the oscillations of the arc position setting-right systems can be sufficiently suppressed.

A photo diode array may be used in lieu of the photo diodes. In such a case, the spacing between the photo diodes for phase detection can be decreased to reduce the size of the arc position detector, and multiplexing of the light detectors for arc position detection is facilitated. Further, a lens or the like may be used in lieu of the pin hole. In each of the above cases, fluctuation of the lamp light output focused on the inlet slit of the spectro-photometer 6 can be easily decreased to less than 0.05% which is generally equivalent to that of the light output of a deuterium lamp which generates light very stably.

It will be understood from the foregoing description that, according to the apparatus for stabilizing the light output of a high pressure discharge lamp embodying the present invention, fluctuation of the light output of the high pressure discharge lamp due to arc position deviation, snaking or the like can be set right, and the resultant variation of the quantity of the light output can be suppressed. In the apparatus for stabilizing the light output of the high pressure discharge lamp according to the present invention, prevention of deviation of the arc from the predetermined position as well as prevention of mal-operation due to, for example, abnormal oscillation can be successfully attained, and, at the same time, highly accurate control of the arc position to reduce undesirable fluctuation of the light output to less than 0.05% can also be successfully attained. Therefore, an undesirable variation of the quantity of the light output can be prevented without impairing the reliability of the operation of the high pressure discharge lamp.

We claim:

1. An apparatus for stabilizing the light output of a high pressure discharge lamp comprising means for generating a magnetic field acting upon the arc of said high pressure discharge lamp, means for detecting deviation of the position of said arc to generate an output signal representing the detected deviation of the arc position, and means for controlling said magnetic field generating means in response to the output signal of said detecting means thereby setting right the position of said arc in said high pressure discharge lamp.

2. An apparatus according to claim 1, wherein said arc position detecting means is disposed on a light axis of said light output.

3. An apparatus according to claim 1, wherein said means for detecting includes a plurality of light detectors having respectively different monitoring ranges of said arc position, and means for multiplexing of the light detectors for arc position detection.

4. An apparatus according to claim 1, including two of said means for generating, two of said means for detecting, and two of said means for controlling, respectively arranged orthogonally of each other to compensate for deviation of the arc position with respect to two orthogonally related light axes, respectively.

5. An apparatus according to claim 4, wherein one of said axes is disposed on a light axis of said light output.

6. An apparatus according to claim 1, wherein said means for detecting includes a first light detector means for monitoring a fixed range of said arc position and a second light detector means for monitoring a substantially larger range of arc position with less accuracy than said first light detector means; and said means for controlling being responsive only to the output signal of said first light detector means when said output signal is below a fixed level and being responsive to the output signal of said second light detector means when said output signal of said first light detector means is above said fixed value.

* * * * *